US007108548B2

(12) United States Patent
Burris et al.

(10) Patent No.: US 7,108,548 B2
(45) **Date of Patent: *Sep. 19, 2006**

(54) SEALED COAXIAL CABLE CONNECTOR

(75) Inventors: Donald A. Burris, Peoria, AZ (US); Herman P. Durst, Maricopa, AZ (US); David M. Kearsey, Glendale, AZ (US); William B. Lutz, Glendale, AZ (US); Steven E. Sundvold, Queen Creek, AZ (US); Kenneth S. Wood, Elmira, NY (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/121,473

(22) Filed: May 2, 2005

(65) Prior Publication Data

US 2005/0208827 A1 Sep. 22, 2005

Related U.S. Application Data

(63) Continuation of application No. 10/142,274, filed on May 8, 2002, now Pat. No. 6,790,081.

(51) Int. Cl.
*H01R 9/05* (2006.01)

(52) U.S. Cl. ..... 439/578

(58) Field of Classification Search ..... 439/578, 439/585

See application file for complete search history.

(56) References Cited

U.S. PATENT DOCUMENTS

| | | | | |
|---|---|---|---|---|
| 2,731,610 | A | 1/1956 | Thacker | 339/89 |
| 3,264,602 | A | 8/1966 | Schwartz | 339/177 |
| 3,787,796 | A | 1/1974 | Barr | 339/60 R |
| 4,059,330 | A | 11/1977 | Shirey | 339/177 |
| 4,400,050 | A | 8/1983 | Hayward | 339/177 R |
| 4,575,274 | A | 3/1986 | Hayward | 403/2 |
| 4,583,809 | A | 4/1986 | Werth et al. | 339/143 R |
| 4,684,201 | A | 8/1987 | Hutter | 439/585 |
| 4,735,442 | A | 4/1988 | Bürli | 285/175 |
| 4,755,152 | A | 7/1988 | Elliot et al. | 439/452 |

(Continued)

*Primary Examiner*—Neil Abrams
(74) *Attorney, Agent, or Firm*—Joseph M. Homa

(57) ABSTRACT

A connector is provided for coupling an end of a coaxial cable to a terminal, such as a cable terminal, a terminal for coupling to another connector, and the like The connector includes a coupler, such as a nut, having a receiving port for engaging the terminal. The coupler also includes an annular collar. The connector also includes a body member, one end of which includes a lip. The lip is inserted through the collar opening. The other end of the body section includes an inner surface portion. The connector still further includes a post, an end of which is sized for insertion between the dielectric and the outer conductor of the cable. The post further includes a post flange and a post shank. The post shank forms a post channel sufficient in diameter to receive the inner conductor and the dielectric of the cable. The post is movable between a cable-insertion position and a cable-installed position. In the cable-installed position, the post shank is received in the body member to form an annular chamber between the post shank and the inner surface portion. The annular chamber is sufficiently narrow in this cable-installed position to compress the outer conductor and the jacket with the post shank and the inner surface portion for establishing a distal seal. Tightening of the coupler to the terminal compresses the lip between the post flange and the annular collar for establishing a proximal seal. Related methods also are provided.

8 Claims, 5 Drawing Sheets

U.S. PATENT DOCUMENTS

| | | | | | |
|---|---|---|---|---|---|
| 4,772,223 | A | * | 9/1988 | Yasumoto | 439/578 |
| 4,808,128 | A | | 2/1989 | Werth | 439/610 |
| 4,824,400 | A | | 4/1989 | Spinner | 439/578 |
| 4,834,675 | A | | 5/1989 | Samchisen | 439/578 |
| 4,902,246 | A | | 2/1990 | Samchisen | 439/578 |
| 4,990,106 | A | | 2/1991 | Szedga | 439/585 |
| 5,002,503 | A | | 3/1991 | Campbell et al. | 439/578 |
| 5,024,606 | A | | 6/1991 | Ming-Hwa | 439/578 |
| 5,073,129 | A | | 12/1991 | Szedga | 439/585 |
| 5,083,943 | A | | 1/1992 | Tarrant | 439/583 |
| 5,127,853 | A | | 7/1992 | McMills et al. | 439/578 |
| 5,141,451 | A | | 8/1992 | Down | 439/585 |
| 5,217,393 | A | | 6/1993 | Del Negro et al. | 439/585 |
| 5,295,864 | A | | 3/1994 | Birch et al. | 439/578 |
| 5,435,745 | A | | 7/1995 | Booth | 439/584 |
| 5,456,614 | A | | 10/1995 | Szegda | 439/321 |
| 5,466,173 | A | | 11/1995 | Down | 439/584 |
| 5,470,257 | A | | 11/1995 | Szegda | 439/578 |
| 5,499,934 | A | | 3/1996 | Jacobsen et al. | 439/585 |
| 5,501,616 | A | | 3/1996 | Holliday | 439/585 |
| 5,525,076 | A | | 6/1996 | Down | 439/585 |
| 5,571,028 | A | | 11/1996 | Szegda | 439/322 |
| 5,586,854 | A | | 12/1996 | Sakai et al. | 411/429 |
| 5,595,499 | A | | 1/1997 | Zander et al. | 439/352 |
| 5,607,720 | A | | 3/1997 | Wallace et al. | 427/181 |
| 5,632,651 | A | | 5/1997 | Szegda | 439/578 |
| 5,800,211 | A | | 9/1998 | Stabile et al. | 439/578 |
| 5,857,865 | A | | 1/1999 | Shimirak et al. | 439/277 |
| 5,866,849 | A | | 2/1999 | Tuvy et al. | 174/74 A |
| 5,975,951 | A | | 11/1999 | Burris et al. | 439/585 |
| 5,997,350 | A | | 12/1999 | Burris et al. | 439/585 |
| 6,089,912 | A | | 7/2000 | Tallis et al. | 439/584 |
| 6,089,913 | A | | 7/2000 | Holliday | 439/584 |
| 6,113,410 | A | | 9/2000 | Heit et al. | 439/321 |
| 6,146,197 | A | | 11/2000 | Holliday et al. | 439/585 |
| 6,153,830 | A | | 11/2000 | Montena | 174/88 C |
| 6,179,656 | B1 | | 1/2001 | Wong | 439/578 |
| 6,210,222 | B1 | | 4/2001 | Langham et al. | 439/583 |
| 6,217,383 | B1 | | 4/2001 | Holland et al. | 439/578 |
| 6,241,553 | B1 | | 6/2001 | Hsia | 439/578 |
| 6,261,126 | B1 | | 7/2001 | Stirling | 439/583 |
| 6,267,621 | B1 | | 7/2001 | Pitschi et al. | 439/584 |
| 6,331,123 | B1 | | 12/2001 | Rodrigues | 439/584 |
| 2002/0013088 | A1 | | 1/2002 | Rodrigues et al. | 439/578 |

* cited by examiner

SEALED COAXIAL CABLE CONNECTOR

This is a continuation of U.S. patent application Ser. No. 10/142,274 filed May 8, 2002 now U.S. Pat. No. 6,790,081 issue on Sep. 14, 2004, the content of which is relied upon and incorporated herein by reference in its entirety, and the benefit of priority under 35 U.S.C. § 120 is hereby claimed.

BACKGROUND OF THE INVENTION

1. Field of the Invention

The present invention relates generally to connectors for coupling cables to terminals, or to one another, etc., and methods for assembling and using the same. More specifically, the invention relates to connectors for coaxial cables and related methods, wherein the connector can provide an environmental sealing role.

2. Description of Related Art

There are many applications in which it is advantageous to connect a coaxial cable to a terminal, another coaxial cable, and the like. Coaxial cable F-connectors, for example, are often used to terminate coaxial cables, such as a drop cable in a cable television system. Such coaxial cables typically include a center or inner conductor surrounded by a dielectric or core, in turn surrounded by an outer conductor or braid, which in turn is surrounded by an outer insulator referred to as a jacket. The F-connector is secured over the prepared end of the jacketed coaxial cable, allowing the end of the coaxial cable to be threadedly connected with a threaded terminal block.

A problem with prior coaxial cable designs, particularly in outdoor applications, has involved unwanted infiltration of moisture at the connector and into the interior of the cable. This can impair performance, for example, by leading to corrosion, affecting the electrical characteristics within the cable, increasing contact resistance, reducing signal strength, causing excessive RF leakage from the connector, etc. Those skilled in the art have made various efforts to form a seal between the connector and the jacket of the coaxial cable to preclude such moisture ingress. Connectors are known in the cable television industry wherein special sealing compounds and/or o-ring seals are included in an effort to form leakproof seals.

Crimp style F-connectors are known, for example, wherein a crimp sleeve is included as part of the connector body. A special radial crimping tool, typically having jaws that form a hexagon, is used to radially crimp the crimp sleeve around the outer jacket of the coaxial cable to secure such a crimp style F-connector over the prepared end of the coaxial cable. Examples of such crimp connectors are disclosed in U.S. Pat. No. 4,400,050 to Hayward, assigned to Gilbert Engineering Co., Inc.; and U.S. Pat. No. 4,990,106 to Szegda. U.S. Pat. No. 4,755,152 to Elliot et al. discloses a crimp connector incorporating a gel or other movable sealing material within a cavity of the connector to form a seal between the jacket of the coaxial cable and the interior of the F-connector.

Still another form of F-connector is known wherein an annular compression sleeve is used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for allowing the end of the coaxial cable to be passed through such compression sleeve prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen, which discloses a compression sleeve type F-connector known in the industry as "SNAP-N-SEAL," commercially available from LRC (Thomas & Betts). A number of commercial tool manufacturers provide compression tools for axially compressing the compression sleeve into such connectors. The CablePrep division of Ben Hughes Communication Products Company of Chester, Conn., for example, sells such a hand-operated compression tool under the commercial designation "TERMINX."

The aforementioned "SNAP-N-SEAL" compression connector requires substantial manipulation by an installer. The installer must detach the annular compression sleeve from the connector, slide the compression sleeve over the end of the coaxial cable, then install the connector, and finally compress the compression sleeve into the body of the connector. During assembly, the compression sleeve can easily become lost because of its typically small size and because it must be detachable from a mounting neck. In addition, such "SNAP-N-SEAL" connectors are significantly more expensive than conventional crimp style connectors.

Yet another radial compression-type F-connector is disclosed in U.S. Pat. No. 5,470,257 to Szegda. A tubular locking member protrudes axially into the open rear end of the outer collar or sleeve. The tubular locking member is displaceable axially within the outer collar between an open position accommodating insertion of the tubular post into the prepared end of the coaxial cable, and a clamped position fixing the end of the cable within the F-connector. An O-ring is mounted on the rear end of the tubular locking member to seal the connection between the tubular locking member and the outer collar as the tubular locking member is axially compressed. Such connectors have been sold in the past under the designation "CMP" by PPC Industries. The O-ring provided on the tubular locking member is exposed and unprotected prior to axial compression of the F-connector.

It is generally known in the coaxial cable field that collars or sleeves within a coaxial cable connector can be compressed inwardly against the outer surface of a coaxial cable to secure a coaxial cable connector thereto. For example, in U.S. Pat. No. 4,575,274 to Hayward and assigned to Gilbert Engineering Company Inc., a connector assembly for a signal transmission system is disclosed wherein a body portion threadably engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. In some situations, the connector shown in the Hayward '274 patent can not be installed quickly, as by a simple crimp or compression tool. Rather, the mating threads of such connector generally must be tightened, for example, using a pair of wrenches.

Known coaxial cable connectors typically require a number of components to secure the cable to the terminal, splice, etc., and attempting to do so in a way that a suitable environmental seal is obtained. The need for these various components results in added relative cost of the components themselves, as well as the costs associated with maintaining parts inventories, assembly time and effort, installation time and effort, etc.

OBJECTS OF THE INVENTION

Accordingly, an object of this invention is to provide connectors and related methods wherein a suitable environmental seal is provided to limit or prevent in ingress of moisture into the interior of the cable.

Another object of the invention is to provide connectors and methods that can be made and used economically.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve foregoing objects, and in accordance with the purposes of the invention as embodied and broadly described in this document, a connector is provided for coupling an end of a coaxial cable to a terminal in accordance with a first aspect of the invention. The first aspect of the invention can be suitable for use with, for example, a coaxial cable comprising an inner conductor, a dielectric surrounding the inner conductor, an outer conductor surrounding the dielectric, and a jacket surrounding the outer conductor.

The connector comprises a coupler comprising a substantially cylindrical portion having a receiving port for engaging the terminal of the coaxial cable. The coupler further comprises an annular collar extending radially inward from the substantially cylindrical portion to provide a collar opening having an opening diameter. The connector further comprises a body member comprising a distal body end, a proximal body end, a proximal body section receivable in the collar opening, and a distal body section. The proximal body section comprises a lip at the proximal body end, the lip having an outer lip diameter greater than the opening diameter. The body member is sufficiently resilient for flexible insertion of the lip through the collar opening. The distal body section extends axially away from the distal coupler end and the proximal body section. The distal body section comprises an inner surface portion. The connector still further comprises a post comprising a distal post end and a proximal post end, the distal post end sized for insertion between the dielectric and the outer conductor. The post further comprises a radially extending post flange movable within the receiving port, and a post shank. The post shank extends from the post flange and forms a post channel sufficient in diameter to receive the inner conductor and the dielectric. The post shank is sufficient in length to extend from the lip to the inner surface portion. The post is movable between a cable-insertion position and a cable-installed position. In the cable-insertion position, the post flange is spaced apart from the lip and the distal post end is spaced sufficiently axially apart from the inner surface portion for inserting coaxial cable into the body member. In the cable-installed position, the post shank is received in the body member to form an annular chamber between the post shank and the inner surface portion. The annular chamber is sufficiently narrow in this cable-installed position to compress the outer conductor and the jacket with the post shank and the inner surface portion for establishing a distal seal. Tightening of the coupler to the terminal compresses the lip between the post flange and the annular collar for establishing a proximal seal.

Preferably, the coupler and post each comprise, and more preferably consist of a metallic, conductive material. Brass is a suitable metallic, conductive material for the coupler and post, although the coupler and post may be the same or different materials. The body member preferably comprises, and more preferably consists of, plastic.

The coupler and terminal preferably each comprises respective threads that, when engaged and tightened, compress the lip between the post flange and the annular collar for establishing the proximal seal. The coupler is preferably a nut.

The body member preferably comprises an annular shoulder integrally connecting the proximal body section and the distal body section to one another, with the collar disposed between the lip and the annular shoulder. In this embodiment, the lip and the annular shoulder are preferably spaced apart by a sufficient distance to permit limited axial movement of the collar of the coupler therebetween before the coupler is engaged with the terminal. The limited axial movement avoids significant engagement of the collar with the lip and permits free-spinning movement of the coupler relative to both the post and the body member until the coupler is tightened onto the terminal.

In another preferred variation of this first aspect of the invention, the lip has a forward chamfer. According to one preferred variation, the lip comprises an elastically deformable material for elastically deforming when the lip is compressed between the post flange and the annular collar. According to another preferred variation, the lip comprises a plastically deformable material for plastically deforming when the lip is compressed between the post flange and the annular collar. Arrangements in which the lip material is partially plastically deformable and/or partially elastically deformable also are possible.

Preferably, the proximal body section and the distal body section are each cylindrical. It is also preferred that the inner surface portion comprise a tapered region tapering radially inward in a direction from the proximal body end towards the distal body end. The post shank is preferably sufficient in length to extend from the lip or proximal body end into the tapered region.

The post shank according to this first aspect of the invention may comprise an outer surface comprising at least one barb, and preferably, a plurality of barbs. These barbs, for example, may be used to grip or trap the outer conductor and the protective outer jacket of the coaxial cable. Preferably, the post is concentric with the coupler and the body member.

According to another preferred embodiment of this first aspect of the invention, the body member further comprises an annular shoulder integrally connecting the proximal body section and the distal body section to one another. The post has an outer surface comprising at least one barb abutting against the distal shoulder end when the post is in the cable-installed position. It is also preferred that the post flange abuts against the proximal end of the body member when the post is in the cable-installed position.

The connector of this first aspect of the invention may be free of any O-rings or sealing compounds, e.g., gels or compounds, for sealing engagement between the coupler, the body member, and the post, although the use of o-rings and/or sealing compounds may be used if desired.

According to a second aspect of the invention, a connector is provided for establishing proximal and distal seals with the terminal and the coaxial cable, respectively. The connector is especially useful with a coaxial cable comprising an inner conductor, a dielectric surrounding the inner conductor, an outer conductor surrounding the dielectric, and a jacket surrounding the outer conductor. According to this second aspect, the connector comprises a coupler comprising an outer portion providing a receiving port for coupling to the terminal. The coupler further comprises an annular collar extending radially inward from the outer portion to provide a collar opening having an opening diameter. The connector further comprises a body member comprising an inner surface portion. The connector further comprises a post having a distal post end and a proximal post end, the distal post end sized for insertion between the dielectric and the outer conductor. The post comprises a radially extending post flange, and a post shank extending from the post flange. The post shank forms a post channel sufficient in diameter to receive the inner conductor and the dielectric. The post shank is sufficient in length to extend from the annular collar to the inner surface portion.

According to this second aspect of the invention, the post is movable between a cable-insertion position and a cable-installed position. In the cable-insertion position, the distal post end is sufficiently spaced apart from the inner surface portion for inserting the coaxial cable into the body member. In the cable-installed position, the post shank is inserted in the body member to form an annular chamber between the post shank and the inner surface portion. The annular chamber is sufficiently narrow to compress the outer conductor and the jacket with the post shank and the inner surface portion for establishing a distal seal.

Preferably, for this second aspect the coupler and post each comprise, and more preferably consist of a metallic, conductive material. Brass or plated brass is a suitable metallic, conductive material for the coupler and post, although the coupler and post may be the same or different materials. The body member preferably comprises, and more preferably consists of, a plastic material.

The body member preferably comprises a proximal body section, a distal body section, and an annular shoulder integrally connecting the proximal body section and the distal body section to one another. In this variation, the proximal body section and the distal body section are each preferably cylindrical.

In another preferred variation of this second aspect of the invention, the body member further comprises a proximal body end and a distal body end, the proximal body end being in closer proximity to the coupler than the distal body end. The inner surface portion comprises a tapered region tapering radially inward in a direction from the proximal body end towards the distal body end. The post shank is preferable sufficient in length to extend from the proximal body end into the tapered region.

The post shank of this second aspect of the invention also may have at least one barb, and preferably a plurality of barbs. Preferably, the post is concentric with the coupler and the body member.

According to another preferred embodiment of this second aspect of the invention, the body member further comprises an annular shoulder integrally connecting the proximal body section and the distal body section to one another. The post has an outer surface comprising at least one barb abutting against the distal shoulder end when the post is in the cable-installed position. It is also preferred that the post flange abuts against the proximal end of the body member when the post is in the cable-installed position.

The connector of this second aspect of the invention optionally may be free of any O-rings or sealing compounds, e.g., gels, for sealing engagement between the coupler, the body member, and the post.

In accordance with a third aspect of the invention, a connector is provided for coupling an end of a coaxial cable to a terminal for establishing a proximal seal between the connector and terminal The connector according to this third aspect of the invention is especially useful with a coaxial cable comprising an inner conductor, a dielectric surrounding the inner conductor, an outer conductor surrounding the dielectric, and a jacket surrounding the outer conductor. The connector according to this third aspect comprises a coupler comprising a substantially cylindrical portion having a receiving port for engaging the terminal, and an annular collar extending radially inward from the substantially cylindrical portion to provide a collar opening having an opening diameter. The connector further comprises a body member and a post. The body member comprises a distal body end, a proximal body end, a proximal body section receivable in the collar opening and comprising a lip at the proximal body end, the lip having an outer lip diameter greater than the opening diameter. The body member is sufficiently resilient for flexible insertion of the lip through the collar opening. The distal body section extends away from the proximal body section. The post comprises a distal post end sized for insertion between the dielectric and the outer conductor, a proximal post end, a radially extending post flange movable within the receiving port, and a post shank. The post shank extends from the post flange. The post shank forms a post channel sufficient in diameter to receive the inner conductor and the dielectric. The post is movable between a cable-insertion position and a cable-installed position. In the cable-insertion position, the post flange is spaced apart from the lip and the coaxial cable is insertable into the body member. In the cable-installed position, the post flange abuts the lip. Tightening the coupler to the terminal compresses the lip between the post flange and the annular collar for establishing a proximal seal.

Preferably, the coupler and post each comprise, and more preferably consist of, a metallic, conductive material. Brass or plated brass is a suitable metallic, conductive material for the coupler and post, although the coupler and post may be the same or different materials. The body member preferably comprises, and more preferably consists of, a plastic.

The coupler preferably rotatably engages the proximal body section to facilitate connection of the coupler to a terminal. The coupler and the terminal each preferably comprise respective threads, which, when engaged with and tightened to one another, compress the lip between the post flange and the annular collar for establishing a proximal seal. The coupler of this variation is preferably a nut.

The body member preferably comprises an annular shoulder integrally connecting the proximal body section and the distal body section to one another, with the collar disposed between the lip and the annular shoulder. In this embodiment, the lip and the annular shoulder are preferably spaced apart by a sufficient distance to permit limited axial movement of the collar of the coupler therebetween before the coupler is tightened to the terminal. The limited axial movement avoids significant engagement with the lip and permits free-spinning movement of the coupler relative to both the post and the body member until the coupler is tightened onto the terminal.

In another preferred variation of this third aspect of the invention, the lip has a forward chamfer. According to one preferred variation, the lip comprises an elastically deformable material for elastically deforming when the lip is compressed between the post flange and the annular collar. According to another preferred variation, the lip comprises a plastically deformable material for plastically deforming when the lip is compressed between the post flange and the annular collar. Partially deformable and/or elastic materials also may be used.

Preferably, the proximal body section and the distal body section are each cylindrical.

The post shank of this third aspect of the invention also may have at least one barb, as described above. Preferably, the post is concentric with the coupler and the body member.

According to another preferred embodiment of this third aspect of the invention, the body member further comprises an annular shoulder integrally connecting the proximal body section and the distal body section to one another. The post has an outer surface comprising at least one barb abutting against the distal shoulder end when the post is in the cable-installed position. It is also preferred that the post flange abuts against the proximal end of the body member when the post is in the cable-installed position.

The connector of this third aspect of the invention also optionally may be free of any O-rings or sealing compounds for sealing engagement between the coupler, the body member, and the post.

In accordance with a fourth aspect of the invention, a method is provided for coupling an end of a coaxial cable to a terminal using a connector, and establishing proximal and distal seals. The coaxial cable comprises an inner conductor, a dielectric surrounding the inner conductor, an outer conductor surrounding the dielectric, and a jacket surrounding the outer conductor. According to this fourth aspect, the method comprises:

(a) providing a coupler comprising a substantially cylindrical portion having a receiving port for engaging the terminal, and an annular collar extending radially inward from the substantially cylindrical portion to provide a collar opening having an opening diameter;

(b) providing a body member comprising a distal body end and a proximal body end, a proximal body section, and a distal body section, the proximal body section being receivable in the collar opening and comprising a lip at the proximal body end, the lip having an outer lip diameter greater than the opening diameter, the body member being sufficiently resilient for flexible insertion of the lip through the collar opening, the distal body section extending away from the proximal body section and comprising an inner surface portion;

(c) inserting the lip through the collar opening while flexing the lip inward to situate the proximal body section in the collar opening;

(d) providing a post comprising a distal post end, a proximal post end, a radially extending post flange movable within the receiving port, and a post shank having a post channel;

(e) passing the coaxial cable into the body member;

(f) moving the post shank through the coupler and into the body member and inserting the post shank between the dielectric and the outer conductor of the coaxial cable to receive the dielectric and the inner conductor in the post channel and to compress the outer conductor and the jacket in an annular chamber between the post shank and the inner surface portion for establishing a distal seal; and (g) engaging the coupler with the terminal and compressing the lip between the post flange and the annular collar for establishing a proximal seal.

In this fourth aspect, the coupler and the terminal each preferably comprises respective threads that are engaged with and tightened to one another for compressing the lip between the post flange and the annular collar for establishing the proximal seal. The coupler is preferably a nut.

The inner surface portion preferably comprises a tapered region tapering radially inward in a direction from the proximal body end towards the distal body end. The post shank is preferably sufficient in length to extend from the lip or proximal body end into the tapered region.

According to any variation of the fourth embodiment, the body member further comprises an annular shoulder integrally connecting the proximal body section and the distal body section to one another, so that the collar may be situated between the lip and the annular shoulder. The lip preferably has a forward chamfer for facilitating the inserting step (c). The lip and the annular shoulder are preferably spaced apart from one another by a sufficient distance to permit limited axial movement of the collar between the lip and the annular shoulder before the coupler is engaged with the terminal. The limited axial movement avoids significant engagement of the collar with the lip and permits free-spinning movement of the coupler relative to both the post and the body member until the coupler is engaged with the terminal.

The post shank preferably has an outer surface comprising at least one barb, and optionally a plurality of barbs, e.g., for trapping the outer conductor and the jacket of the coaxial cable. In the event that the body member comprises an annular shoulder, one of the barbs may abut against the distal shoulder end to prevent forward movement of the post relative to the distal shoulder end.

The post flange is preferably moved until it abuts against the proximal end of the body member. Compression of the lip between the post flange and the annular collar may comprise elastic deformation and/or plastic deformation, and/or combinations of these.

In accordance with a fifth aspect of the invention, a method is provided for coupling an end of a coaxial cable to a terminal using a connector, and establishing a distal seal. The coaxial cable comprises an inner conductor, a dielectric surrounding the inner conductor, an outer conductor surrounding the dielectric, and a jacket surrounding the outer conductor. According to this fifth aspect, the method comprises:

(a) providing a coupler comprising an outer portion providing a receiving port for coupling to the terminal, and an annular collar extending radially inward from the outer portion to provide a collar opening having an opening diameter;

(b) providing a body member comprising an inner surface portion;

(c) inserting the body member into the annular collar to join the coupler and the body member to one another;

(d) providing a post comprising a distal post end, a proximal post end, a radially extending post flange movable within the receiving port, and a post shank extending from the post flange, the distal post end sized for insertion between the dielectric and the outer conductor, the post shank forming a post channel sufficient in diameter to receive the inner conductor and the dielectric, the post shank being sufficient in length to extend from the annular collar to the inner surface portion, (e) passing the coaxial cable into the body member; and (f) moving the post through the coupler and into the body member and inserting the post shank between the dielectric and the outer conductor of the coaxial cable to receive the dielectric and the inner conductor in the post channel and to compress the outer conductor and the jacket in an annular chamber between the post shank and the inner surface portion for establishing a distal seal.

In accordance with this fifth aspect of the invention, the body member preferably further comprises a proximal body end and a distal body end, the proximal body end being in closer proximity to the coupler than the distal body end. The inner surface portion preferably comprises a tapered region tapering radially inward in a direction from the proximal body end towards the distal body end. Preferably, the post shank is sufficient in length to extend from the lip to the tapered region.

As the coaxial cable is passed into the body member, the post flange preferably is maintained axially spaced apart from the annular collar. The post shank preferably has an outer surface comprising at least one barb or a plurality of barbs. As the post shaft is moved per step (f), the barb traps the outer conductor and the jacket of the coaxial cable. In the event that the body member comprises an annular shoulder integrally connecting proximal and distal body sections of the body member, the barb against the distal shoulder end to prevent forward movement of the post relative to the distal shoulder end.

The moving step (f) may be conducted abut the post flange against the proximal end of the body member.

In accordance with a sixth aspect of the invention, a method is provided for coupling an end of a coaxial cable to a terminal using a connector, and for establishing a proximal seal. The coaxial cable comprises an inner conductor, a dielectric surrounding the inner conductor, an outer conductor surrounding the dielectric, and a jacket surrounding the outer conductor. According to this sixth aspect, the method comprises:

(a) providing a coupler comprising a substantially cylindrical portion having a receiving port for engaging the terminal, and an annular collar extending radially inward from the substantially cylindrical portion to provide a collar opening having an opening diameter;

(b) providing a body member comprising a proximal body end, a distal body end, a proximal body section comprising a lip having an outer lip diameter greater than the opening diameter, and a distal body section extending axially away from the proximal body section;

(c) inserting the lip through the collar opening while flexing the lip inward to situate the proximal body section in the collar opening;

(d) providing a post comprising a distal post end, a proximal post end, a radially extending post flange movable within the receiving port, and a post shank having a post channel;

(e) passing the coaxial cable into the body member;

(f) moving the post shank through the coupler and into the body member and inserting the post shank between the dielectric and the outer conductor of the coaxial cable to receive the dielectric and the inner conductor in the post channel and to receive the outer conductor and the jacket in an annular chamber between the post shank and the inner surface portion; and (g) engaging the coupler with the terminal and compressing the lip between the post flange and the annular collar for establishing a proximal seal.

In accordance with the sixth aspect, preferably each of the coupler and the terminal comprises respective threads, and the respective threads are tightened to compress the lip between the post flange and the annular collar for establishing the proximal seal. The coupler preferably is a nut.

In a preferred modification to the sixth aspect, the body member further comprises an annular shoulder integrally connecting the proximal body section and the distal body section to one another, and the (c) inserting comprises situating the collar between the lip and the annular shoulder. The lip may optionally have a forward chamfer for facilitating insertion of the lip through the annular collar. The lip and the annular shoulder may be spaced apart by a sufficient distance to permit limited axial movement of the collar between the lip and the annular shoulder before the coupler is tightened to the terminal. The limited axial movement avoids significant engagement of the collar with the lip and permits free-spinning movement of the coupler relative to both the post and the body member until the coupler is engaged with the terminal.

The post shank of this sixth aspect preferably has an outer surface comprising at least one barb, wherein the (f) moving comprises trapping the outer conductor and the jacket of the coaxial cable with the barb. In the event that the body member further comprises an annular shoulder integrally connecting the proximal body section and the distal body section to one another, the (f) moving step may comprise abutting the barb against the distal shoulder end to prevent forward movement of the post relative to the distal shoulder end.

According to one variation of the sixth aspect, compressing of the lip between the post flange and the annular collar comprises elastically deforming the lip. According to another variation of the sixth aspect, compressing of the lip between the post flange and the annular collar comprises plastically deforming the lip. Combinations of these also are possible.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF THE PREFERRED EMBODIMENTS AND METHODS OF THE INVENTION

Figure 1:
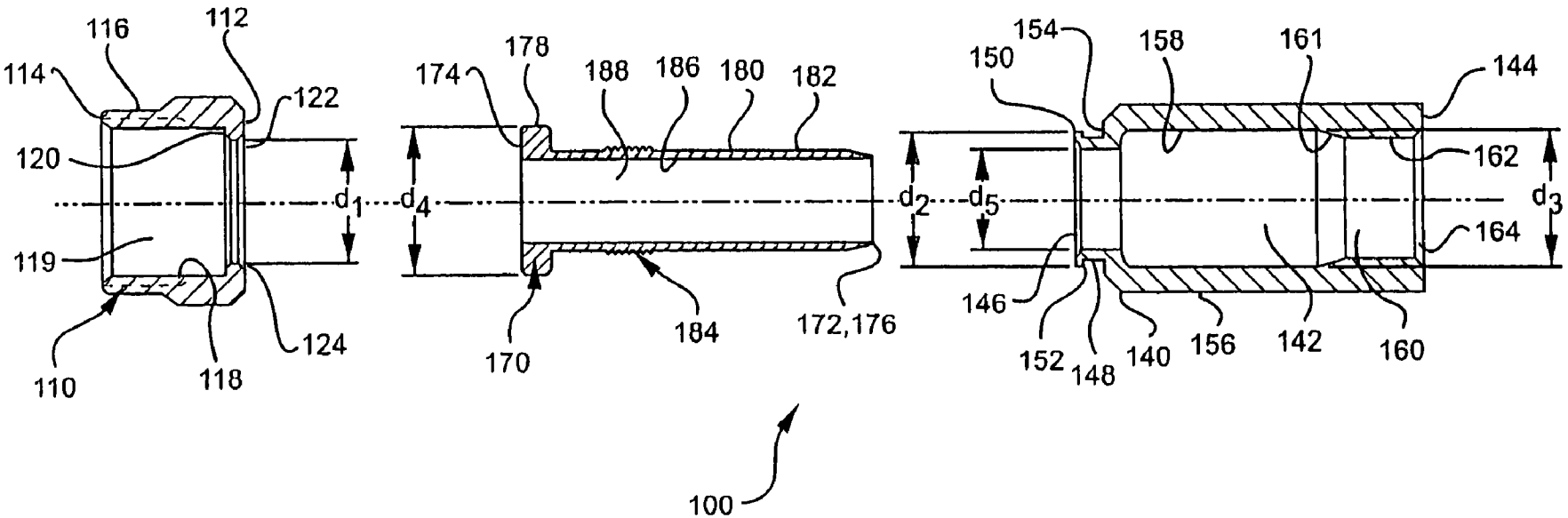
FIG. 1 is a schematic sectional exploded view of a connector in accordance with one preferred embodiment of the invention.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" may include plural referents unless the context clearly dictates otherwise.

FIGS. 1–3 and 5–7 illustrate an example of a connector, generally designated by reference numeral 100, according to a presently preferred embodiment of the invention. Connector 100 also will be used herein below to describe and illustrate a presently preferred method according to the invention. Connector 100, incidentally, comprises both a proximal seal and a distal seal in combination.

Referring to FIG. 1, the connector 100 comprises a coupler in the form of a nut 110. It also comprises a body member 140, and a post 170. The nut 110, the body member 140, and the post 170 may be made of the same or different materials from each other. Preferably, both the nut 110 and the post 170 comprise, and more preferably consist of, a metallic, conductive material, such as brass or plated brass. Preferably, the body member 140 comprises, and more preferably consists of, a material, such as a plastic. Preferably the body member material is different from that of the nut 110 and post 170. The nut 110 and the post 170 may be machined from bar stock on automatic screw machines known in the industry. The plastic body member 140 may be injection molded, or may be made by techniques known in the field.

The nut 110 comprises a distal nut end 112, and a proximal nut end 114 situated forward of the distal nut end 112. A substantially cylindrical portion 116 extends between the distal nut end 112 and the proximal nut end 114. (The term substantially cylindrical as used here is meant to include portions 116 having, for example, a hexagonal or other polygonal outer surface, such as found with known nuts.) The substantially cylindrical portion 116 has an internal surface 118 providing a female port 119. The internal surface 118 of the nut 110 is preferably, yet optionally, threaded for tightening to a male terminal 220 (FIG. 7), which is also preferably yet optionally threaded. The nut 110 further comprises an annular collar 120 situated rearward relative to the female port and extending radially inward from the substantially cylindrical portion 116 to provide a collar opening 122 having an opening diameter $d_1$. The distal face of the annular collar 120 preferably has a chamfered portion 124. The chamfered portion 124 may be shaped at an angle of, for example, 45° relative to the distal nut end 112.

The body member 140 has a central passageway 142, a distal body end 144, and a proximal body end 146 situated forward of the distal body end 144. The body member 140 further comprises a proximal body section 148 comprising a lip 150 at the proximal body end 146. Preferably, the lip 150 is formed as an integral or unitary piece with the remainder of the body member 140. The lip may comprise an elastically deformable material possessing "memory" or a plastically deformable material having limited or no "memory." The lip also may comprise a material and/or be configured to be partially deformable and/or partially elastic. The lip 150 has an outer lip diameter $d_2$ that is greater than the opening diameter $d_1$. The lip 150 preferably has a radius or a forward chamfer 152 for facilitating insertion of the lip 150 through the collar opening 122. The forward chamfer 152 may be shaped at an angle of, for example, 45° relative to the proximal body end 146 or longitudinal axis $L_x$. An annular shoulder 154 integrally connects the proximal body section 148 to a distal body section 156. In the illustrated embodiment, the proximal body section 148 and the distal body section 156 are each cylindrical, although the distal body section 156 has a diameter $d_3$ that is larger than the diameter $d_5$ of the proximal body section 148. The distal body section 156 extends axially away from the proximal body section 148 and has an inner surface 158 with a tapered or indented inner surface portion 160. For example, inner surface portion 160 preferably comprises a tapering region 161 that tapers radially inward in a direction towards the distal body end 144, and a cable jacket sealing surface region 162. The cable jacket sealing surface region 162 has an inner surface of reduced diameter that is preferably substantially parallel to the longitudinal axis $L_x$ of the connector 100. A beveled portion 164 is situated at the distal body end 144. The cable jacket sealing surface region 162 and beveled portion 164 axially space the tapering region 161 from the distal body end 144.

In the illustrated embodiment, the inner surface portion 160 comprises a tapering region 161 and a cable jacket surface sealing region 162 positioned to the rear of the tapering region 161. The inner surface portion 160 optionally may consist of the tapering region 161 alone, that is, exclusive of the cable jacket surface sealing region 162. The tapering region 161 may have a non-linear profile, e.g., a slope that varies over its length. It is also possible to make the inner surface portion linear, that is, free of a tapering or indented region, and/or coextensive with the entire inner surface 158.

The post 170 comprises a distal post end 172, and a proximal post end 174 situated forward of the distal post end 172. The distal post end 172 terminates at an annular ridge or crest 176. The post 170 further comprises a radially extending post flange 178 having an outer diameter $d_4$ that is greater than the opening diameter $d_1$, and greater than diameter $d_5$. Preferably the diameter of the post flange $d_4$ is equal to or greater than the diameter of the lip $d_2$. A post shank 180 extends rearward from the post flange 178. The post shank 180 has an outer surface 182 preferably having at least one elevated portion, e.g., barbs 184, spaced forward of the annular ridge or crest 176. The barbs 184 may be inclined at an angle of, for example, 20° relative to the outer surface 182. An inner surface 186 of the post shank 180 defines a post channel 188.

Figure 2:
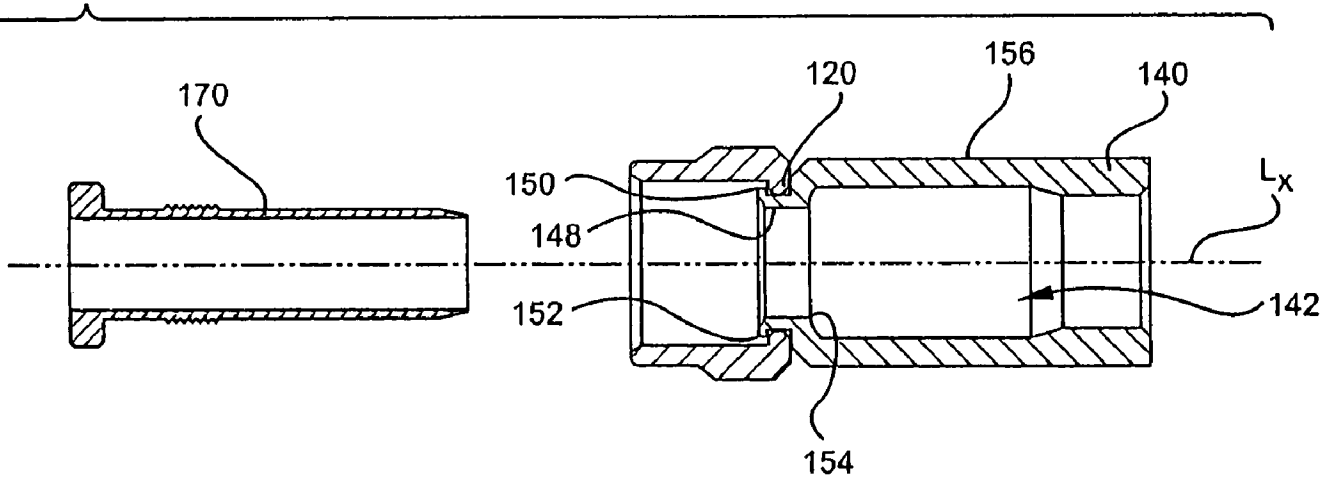
FIG. 2 is a schematic sectional view of the connector of FIG. 1, showing the connector in a partially assembled state with the coupler engaged to the body member.
Figure 7:
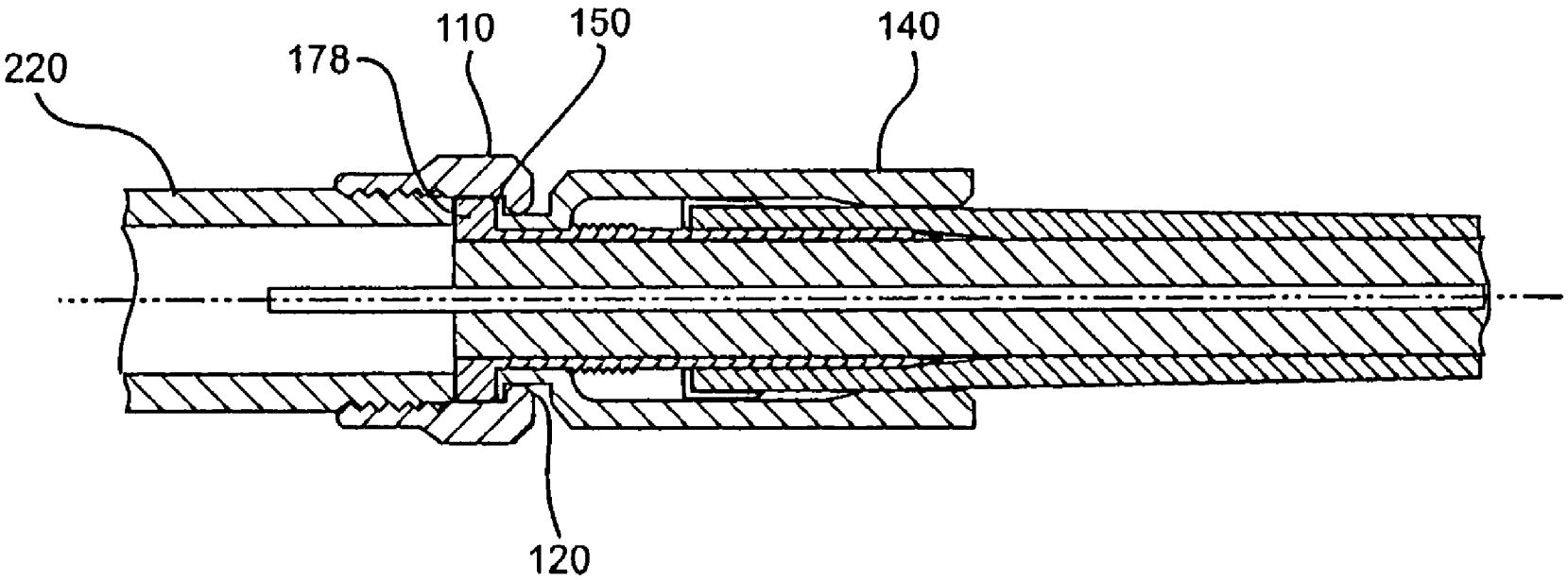
FIG. 7 is a schematic, section view of the connector of FIG. 1, depicted receiving the prepared cable of FIG. 4 and mated to a male threaded terminal.

Referring now to FIG. 2, a method for assembling the connector 100 comprises pressing the nut 110 and body member 140 together so that the lip 150 of the body member 140 is inserted through the collar opening 122 of the collar 120. The body member 140 or a portion thereof, such as the lip 150, and/or the proximal body section 148 preferably is made of a material that is sufficiently flexible to permit the lip 150 to be flexed radially inward to fit through the smaller diameter $d_1$ collar opening 122. The forward chamfer 152 of the lip 150 and the chamfered portion 124 of the collar facilitate insertion of the lip 150 through the collar opening 122. The collar 120 is thereby placed into a surrounding relationship with the proximal body section 148 of the body member 140. Axially, the collar 120 is disposed between the lip 150 and the annular shoulder 154 of the body member 140. Preferably, the lip 150 and the annular shoulder 154 are spaced axially apart by a sufficient distance to permit limited axial movement of the collar 120 of the nut 110 between the lip 150 and the annular shoulder 154 before the nut 110 is threadably tightened to the threaded terminal 220 (FIG. 7). The limited axial movement of the collar 120 avoids significant frictional contact between, on the one hand, the collar 120 and, on the other hand, the lip 150 and the annular shoulder 154. As a consequence, the nut 110 is rotatably engaged to the proximal body section 148. Free-spinning movement of the nut 110 relative to both the post 170 and the body member 140 is thereby permitted, at least until the nut 110 is threadably tightened onto the threaded terminal 220 (FIG. 7).

Figure 3:
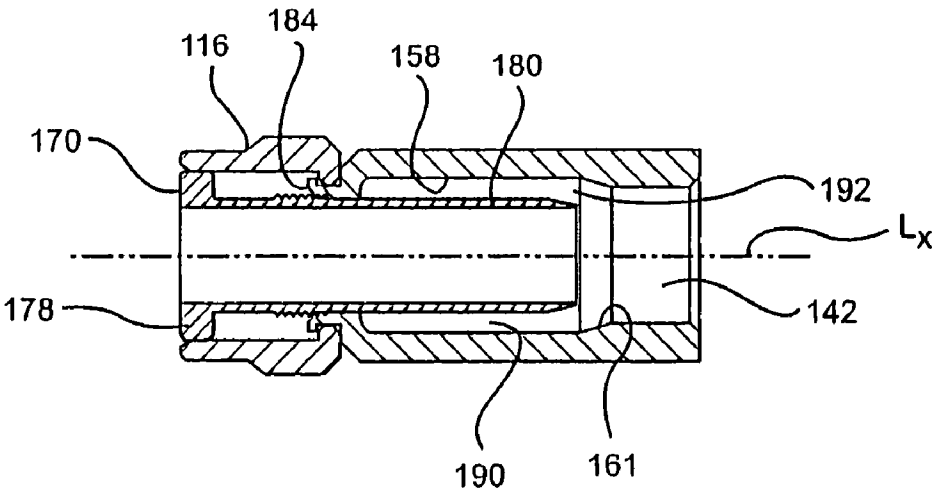
FIG. 3 is a schematic, sectional view of the connector of FIG. 1 in an assembled state, with the post in a cable-insertion position.
Figure 6:
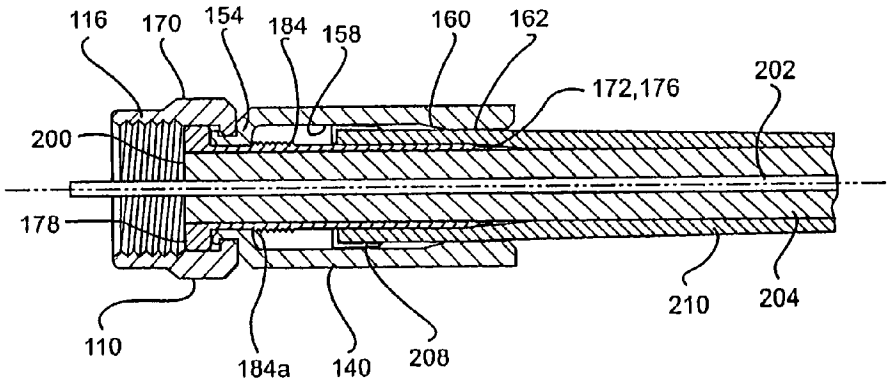
FIG. 6 is a schematic, sectional view of the connector of FIG. 1, depicting the connector in a cable-installed position receiving the prepared cable of FIG. 4.
Figure 6A:
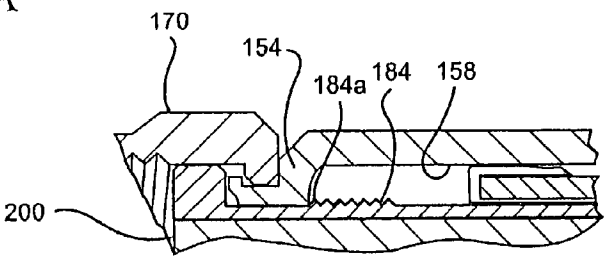
FIG. 6A is a enlarged partial view of the connector of FIG. 6.

FIG. 3 illustrates the post 170 moved into partially installed engagement with the coupled nut 110 and body member 140, and more particularly the post 170 is depicted in a cable-insertion position. As shown in FIG. 3, the nut 110, body member 140, and the post 170 are coaxially aligned with each other along longitudinal axis $L_x$. The post flange 178 is axially moveable within the female port 119 of the substantially cylindrical portion 116 of the nut 110 from the illustrated cable-insertion position to a cable-installed position (FIG. 6). Each of these positions will be described in reference to a coaxial cable in further detail below. The post shank 180 extends from the post flange 178 through the proximal axial section 148 of the body 140 and in the control passageway 142 of the body 140 but spaced away from the inner surface portion 160. The outer surface 182 of the post shank 180 and the inner surface 158 of the body member 140 collectively establish an annular chamber 190 and the distal end of the inner surface 158 forms with a cable-receiving rear entry 192.

Figure 4:
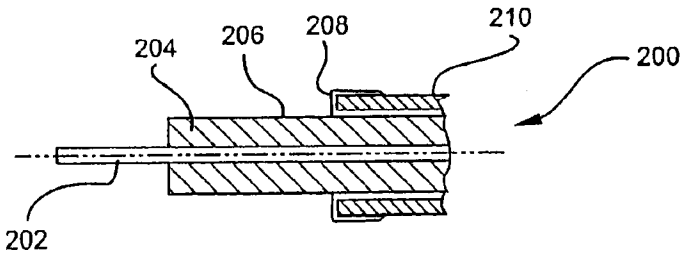
FIG. 4 is a schematic, sectional partial view showing an example of a prepared cable suitable for use with the connector of FIG. 1.

Referring now to FIG. 4, an example of a coaxial cable 200 having a prepared end is shown. The coaxial cable 200 comprises a cable core comprising an inner conductor 202 and a dielectric 204 surrounding the inner conductor 202. The cable core may also include a foil outer conductor 206. An outer conductor (or braid) 208 surrounds the dielectric 204, and a protective outer jacket 210 surrounds the outer conductor 208. To prepare the coaxial cable 200 for insertion into the connector 100, the outer conductor 208 is folded back over the outer surface of the protective outer jacket 210 to expose the outer conductor 208.

Figure 5:
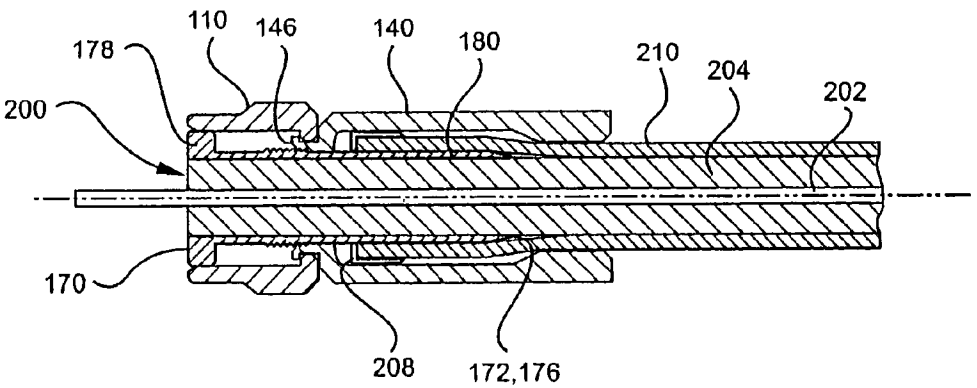
FIG. 5 is a schematic, sectional view of the connector of FIG. 1, depicting the connector in a cable-insertion position receiving the prepared cable of FIG. 4.

Turning now to FIG. 5, a preferred method of engaging the connector 100 with the coaxial cable 200 will be described in further detail. The post 170 is moved into a cable-insertion position, as shown in FIGS. 3 and 5. In the illustrated embodiment, the end of coaxial cable 200 preferably is advanced into the distal body end 142 of body 140 and extends through the cable receiving rear entry 192 until the end of coaxial cable 200 contacts distal post end 172, wherein the end of coaxial cable 200 preferably is spaced away from inner surface region 160, and wherein the longitudinal axes of post shank 180 and coaxial cable 200 preferably substantially coincide. Post 170 is axially driven toward body 140. The distal post end 172 is inserted between the dielectric 204 and the outer conductor 208, more particularly between the foil outer conductor 206 and the braid 208. This can be accomplished, for example, using industry standard assembly tools. The inner conductor 202, the dielectric 204, and the foil outer conductor 206 are thereby received within the post channel 188 of the post shank 180. The outer conductor 208 and the protective jacket 210 are received through the cable-receiving rear entry 192 and into the annular chamber 190. Alternatively, the coaxial cable 200 can be passed through the central passageway 142 of the body member 140 before the post shank 180 is introduced into the distal body section 156.

The post 170 then is moved axially rearward relative to the nut 110 and the body member 140 into the cable-installed position shown in FIG. 6. This preferably is done using an industry standard compression tool. In the cable-installed position, the post flange 178 is advanced axially rearward within the substantially cylindrical portion 116 to place the post flange 178 in close proximity to or abutting relationship with the proximal body end 146. The post shank 180 is sufficient in length to extend to the inner surface portion 160, and more preferably to the cable jacket sealing surface region 162 of the inner surface portion 160. As shown from a comparison of FIG. 5 and FIG. 6, as the post shank 180 is moved from the cable-insertion position rearward to the cable-installed position, the post shank 180 reaches the same axial position as the inner surface portion 160. The annular clearance between the outer surface 182 of post shank 180 and inner surface 158 is smaller at the axial positions coinciding to the inner surface portion 160 (compared to axial positions forward thereof). As a consequence, the outer conductor 208 and the protective outer jacket 210 are compressed between the outer surface 182 of the post shank 180 and the inner surface portion 160, more particularly the cable jacket surface sealing region 162. A first (or distal) moisture-proof seal of the connector 100 is thereby established. This first moisture-proof seal preferably is established without requiring the use of any O-rings or sealing compounds, such as gels, thus reducing processing costs, although O-rings and/or sealing compounds could be added if desired. The first moisture-proof seal may also be established without using a radial crimping tool or member as required by known connectors, thus in most cases cutting down significantly on processing time.

In the cable-installed position shown in FIG. 6, the barbs 184 can limit the axial egress of post 170 past the annular shoulder 154 of body 140. Preferably, a forward-most barb 184*a* abuts against a distal end of the annular shoulder 154 in the cable-installed position. This abutting relationship can inhibit the forward movement of the post 170 relative to the body member 140, thus assisting in preventing unintentional disengagement or loosening of the post 170 from the body member 140.

As shown in FIG. 7, the nut 110 is then threadably tightened onto the threaded male terminal 220. The free-spinning rotational movement permitted between the nut 110 and the body member 140 facilitates threaded engagement of the nut 110 to the threaded terminal 220. As the threaded terminal 220 is advanced into the threaded female port towards the distal nut end 112, the lip 150 is compressed between the post flange 178 and the annular collar 120 of the nut 110. The compressed lip 150 functions to provide a second (proximal) moisture-proof seal at the proximal terminal end of the connector 100 without requiring any additional seal means, such as an o-ring, other elastomeric members, or sealant compounds, such as sealant gels. The elimination of additional sealing means and crimping members or tools can significantly reduce processing time and lower production costs. However, o-rings, other elastomer members, or sealant gels and/or compounds may be added, if desired.

In the preferred embodiment, the connector is a three-piece assembly, and consists of the nut, the body member, and the post. A three-piece assembly can reduce production costs and assembly time compared to connectors comprised of four or more pieces. It should be understood, however, that the inclusion of additional pieces in the assembly also may be within the scope of the invention.

The foregoing detailed description of the preferred embodiments and methods of the invention have been provided for the purposes of illustration and description, and is not intended to be exhaustive or to limit the invention to the precise embodiments and methods disclosed. The embodiments and methods were chosen and described in order to best explain the principles of the invention and its practical application, thereby enabling others skilled in the art to understand the invention for various embodiments and with various modifications as are suited to the particular use contemplated. It is intended that the scope of the invention cover various modifications and equivalents included within the spirit and scope of the appended claims.

What is claimed is:

1. A connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector comprising:

a coupler comprising a substantially cylindrical portion having a receiving port for engaging the terminal and an annular collar extending radially inward from the substantially cylindrical portion;

a body member comprising a proximal body section comprising a lip and an annular shoulder, wherein the annular collar is disposed between the lip and the annular shoulder, and a distal body section having an inner surface with an inner surface portion, wherein the distal body section has a diameter $d_3$ that is larger than a diameter $d_5$ of the proximal body section; and a post comprising:

a distal post end and a proximal post end, the distal post end sized for insertion between the dielectric and the outer conductor, a radially extending post flange, and a post shank extending from the post flange, the post shank forming a post channel sufficient in diameter to receive the inner conductor and the dielectric, the post shank being sufficient in length to extend from the annular collar to the inner surface portion;

wherein the post is movable between a cable-insertion position, in which the distal post end is sufficiently spaced apart from the inner surface portion for inserting the coaxial cable into the body member, and a cable-installed position, in which the post shank is inserted in the body member to form an annular chamber between the post shank and the inner surface portion, the annular chamber being sufficiently narrow to compress the outer conductor and the jacket with the post shank and the inner surface portion for establishing a distal seal.

2. The connector of claim 1 wherein the coupler comprises a nut.

3. The connector of claim 1 wherein the body member comprises plastic.

4. The connector of claim 1 wherein the proximal body section comprises a proximal body end and the distal body section comprises a distal body end, the proximal body end being in closer proximity to the coupler than the distal body end, and wherein the annular shoulder integrally connects the proximal body section and the distal body section to one another.

5. The connector of claim 1 wherein the proximal body section comprises a proximal body end and the distal body section comprises a distal body end, the proximal body end being in closer proximity to the coupler than the distal body end, and wherein the inner surface portion comprises a tapered region tapering radially inward in a direction from the proximal body end towards the distal body end.

6. The connector of claim 5 wherein the post shank is sufficient in length to extend from the proximal body end to the tapered region.

7. The connector of claim 1 wherein the annular shoulder integrally connects the proximal body section and the distal body section to one another, the annular shoulder having a distal shoulder end, and wherein the post shank has an outer surface comprising at least one barb abutting against the distal shoulder end when the post is in the cable-installed position.

8. The connector of claim 1 wherein the proximal body section comprises a proximal body end, and wherein in the cable-installed position, the post flange abuts against the proximal body end of the body member.

* * * * *